US008480043B1

(12) United States Patent
Ventura

(10) Patent No.: US 8,480,043 B1
(45) Date of Patent: Jul. 9, 2013

(54) GROUND ANCHORING FOR TRASH CANS

(76) Inventor: Ronald B. Ventura, Willamsville, NY (US)

( * ) Notice: Subject to any disclaimer, the term of this patent is extended or adjusted under 35 U.S.C. 154(b) by 376 days.

(21) Appl. No.: 12/753,289

(22) Filed: Apr. 2, 2010

(51) Int. Cl.
*A45F 3/44* (2006.01)

(52) U.S. Cl.
USPC ..... 248/156; 248/530; 52/632; 52/165

(58) Field of Classification Search
USPC ..... 248/156, 346.04, 530, 545, 154, 248/507, 508, 509, 533, 607, 907, 97, 99, 248/149, 121, 125.8; 52/632, 165
See application file for complete search history.

(56) References Cited

U.S. PATENT DOCUMENTS

| | | | | | |
|---|---|---|---|---|---|
| 1,135,372 | A | * | 4/1915 | Gibson | 267/71 |
| 1,408,636 | A | * | 3/1922 | Power | 40/613 |
| 2,448,456 | A | | 8/1948 | Niskanen et al. | |
| 2,462,375 | A | * | 2/1949 | Flaherty | 248/312.1 |
| 2,633,317 | A | * | 3/1953 | Marsh | 248/96 |
| 2,690,893 | A | * | 10/1954 | Mokhiber | 248/147 |
| 2,937,760 | A | * | 5/1960 | Williams | 211/85.19 |
| 2,945,659 | A | * | 7/1960 | McDonald | 52/40 |
| 2,971,739 | A | * | 2/1961 | Kirland | 248/500 |
| 3,240,459 | A | * | 3/1966 | Spohn, Jr. | 248/146 |
| 3,279,732 | A | * | 10/1966 | Paul | 248/146 |
| 3,280,527 | A | * | 10/1966 | Faust | 52/301 |
| 3,288,306 | A | | 11/1966 | Walters | |
| 3,527,355 | A | * | 9/1970 | Boyer | 211/85.19 |
| 3,638,802 | A | | 2/1972 | Westerfield | |
| 3,675,783 | A | * | 7/1972 | Reese | 211/85.19 |
| 3,788,584 | A | | 1/1974 | Deike | |
| 4,513,938 | A | * | 4/1985 | Seymour | 248/507 |
| 4,517,775 | A | | 5/1985 | Engel | |
| 4,520,985 | A | * | 6/1985 | Blumenthal | 248/530 |
| 4,559,747 | A | * | 12/1985 | Engel | 52/40 |
| 5,152,495 | A | * | 10/1992 | Jacinto et al. | 248/545 |
| 5,437,423 | A | * | 8/1995 | Sinclair | 248/96 |
| 5,903,991 | A | * | 5/1999 | Sasse | 40/607.04 |
| 6,035,576 | A | * | 3/2000 | Bozeman | 47/47 |
| 6,328,273 | B1 | * | 12/2001 | Kemikem | 248/530 |
| 6,439,517 | B1 | | 8/2002 | Applegate | |
| 6,595,377 | B1 | * | 7/2003 | Hetu | 211/85.23 |
| 6,908,067 | B2 | * | 6/2005 | Clasen | 248/533 |
| 7,322,549 | B2 | * | 1/2008 | Luna-Keaton | 248/154 |
| 7,874,528 | B2 | * | 1/2011 | Keller | 248/97 |
| 2002/0121580 | A1 | | 9/2002 | Grady et al. | |

* cited by examiner

*Primary Examiner* — Nkeisha Smith
(74) *Attorney, Agent, or Firm* — Montgomery Patent & Design; Robert C. Montgomery

(57) ABSTRACT

A ground anchoring system for trash cans designed to secure trash cans from scavenging animals and during windy conditions. The apparatus comprises a steel pole assembly that is anchored in the ground with concrete and extends up from the ground. An upper end of the pole is provided with a decorative cap and at least one (1) hook provided at a position to engage the handles on at least one (1) trash can. The upper end further comprises a spring-loaded mechanism to allow the hooks to ride up and down the pole, thus allowing them to engage trash containers of different sizes, especially those of large wheeled totes.

6 Claims, 3 Drawing Sheets

GROUND ANCHORING FOR TRASH CANS

RELATED APPLICATIONS

The present invention was first described in a notarized Official Record of Invention on Mar. 16, 2009, that is on file at the offices of Montgomery Patent and Design, LLC, the entire disclosures of which are incorporated herein by reference.

FIELD OF THE INVENTION

The present invention relates generally to container retaining apparatus, and more particularly, to a ground anchor for trash cans.

BACKGROUND OF THE INVENTION

The task of taking out the trash is one that most people do not enjoy. Typically, one must endure smelly trash, leaking bags, flies, and other undesirables while taking the day's trash out to the trash can. One (1) facet of this task that is particularly annoying is the fact that many cans, especially when empty, tend to blow all over the yard, get run over and damaged by passing traffic, are disturbed by wild and domestic animals looking for food, or just generally become lost. Those who are unable to retrieve their cans on trash collection day from the curb when they are emptied, usually arrive home to find them nowhere in sight, and must cruise the neighborhood looking for them.

Many support apparatus exist which are intended to retain a trash can or other container in a desired position. Most of the existing holders and supports provide rigid support rack which is secured to the ground surface and include flanges, chains, hooks, or other supports to retain the trash can to the support rack. Some of these apparatus also include a means to adjust the height of the support rack through a series of telescoping members which can be tightened at a desired height. Other apparatus provide a planer stand onto which a bottom end of a trash can is removably mounted.

Examples of these types of apparatus can be seen by example in several U.S. Patents, including: U.S. Pat. Nos. 2,448,456, issued in the name of Niskanen et al.; 3,288,306, issued in the name of Walters; 3,527,355, issued in the name of Boyer; 3,638,802, issued in the name of Westerfield; 4,513,938, issued in the name of Seymour; 4,517,775, issued in the name of Engel; and, 6,439,517, issued in the name of Applegate.

While these supports and holder may provide some benefit related to their respective, particular objectives, each suffers from one (1) or more disadvantage or deficiency with respect to design, function, or effectiveness. These devices are typically designed for use with a particular size and type of trash can. These devices further fail to provide a simple yet effective means of securing the trash cans in a desired location, requiring complicated set up, multiple points of attachment to the trash can, and even require tools to adjust the position of the retaining means or to mount and remove the trash can.

Accordingly, there exists a need for a means by which trash cans can be retained on windy days in a manner that is quick, easy, and effective. The development of the present invention substantially departs from the conventional solutions and in doing so fulfills this need.

SUMMARY OF THE INVENTION

In view of the foregoing art, the inventor recognized the aforementioned inherent problems and observed the need for a novel means by which various sizes and types of trashcans may be secured at a desired location and thus, the object of the present invention is to solve the aforementioned disadvantages and provide for this need.

Another object of the present invention is to provide an apparatus which prevents empty trash cans from blowing away, being toppled due to wind or animals, and being lost or damaged.

Another object of the present invention is to provide an apparatus which increases the aesthetic quality of a yard and a neighborhood.

Another object of the present invention is to provide an apparatus which is securely anchored to the ground surface.

Yet another object of the present invention is to provide an apparatus which is operates at any location and can secure a trash can at alternative points.

Yet another object of the present invention is to provide an apparatus which enables easy access and use of the trash can while secured in a desired location.

Yet another object of the present invention is to provide an apparatus which has an extended useful life.

Yet another object of the present invention is to provide an apparatus which is simple and intuitive to use with little to no training.

Yet another object of the present invention is to provide an apparatus which is durable and economical to manufacture.

To achieve the objects of the invention, a preferred embodiment of the present apparatus includes a ground anchor for trash cans comprising a fixed member which is rigidly mounted to a ground surface having a tubular member with an open top end and a closed bottom end. The fixed member further comprises a lower portion which is inserted into the ground surface. A sliding member is telescopingly mounted to the fixed member and comprises a tubular member having a closed top end and an open bottom end. The sliding member and the fixed member are cooperatively mounted such that the sliding member moves with respect to the fixed member in a vertical direction and the open bottom end of the sliding member receives an upper portion of the fixed member. A planar ground plate is affixed above the lower portion of the fixed member to engage the top of the ground surface and stabilize the fixed member. A hook is affixed to the sliding member to releasably secure the trashcan. A helical compression spring is attached between the fixed member and the sliding member to resist an applied compression force applied by the sliding member when the trash can is releasably secured to the hook.

In the preferred embodiment, the apparatus also provides the lower portion of the fixed member to be secured within a concrete bonding material. The bonding material is applied to a hole in the ground surface and the lower portion of the fixed member includes at least one (1) length of rigidly affixed rebar which provides a means of supporting the fixed member within the bonding material.

Furthermore, the described features and advantages of the invention may be combined in various manners and embodiments as one skilled in the relevant art will recognize. The invention can be practiced without one (1) or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | ground anchor for trash cans |
| 15 | trash can |
| 16 | handle |
| 17 | ground surface |
| 18 | bonding material |
| 20 | cap |
| 30 | hook |
| 40 | "U"-bolt |
| 45 | fastener |
| 50 | sliding member |
| 60 | fixed member |
| 70 | ground plate |
| 80 | support means |
| 90 | first catch |
| 95 | second catch |
| 100 | spring |
| 105 | lower spring hook |
| 106 | upper spring hook |

DETAILED DESCRIPTION OF THE PREFERRED EMBODIMENT

Figure 1:
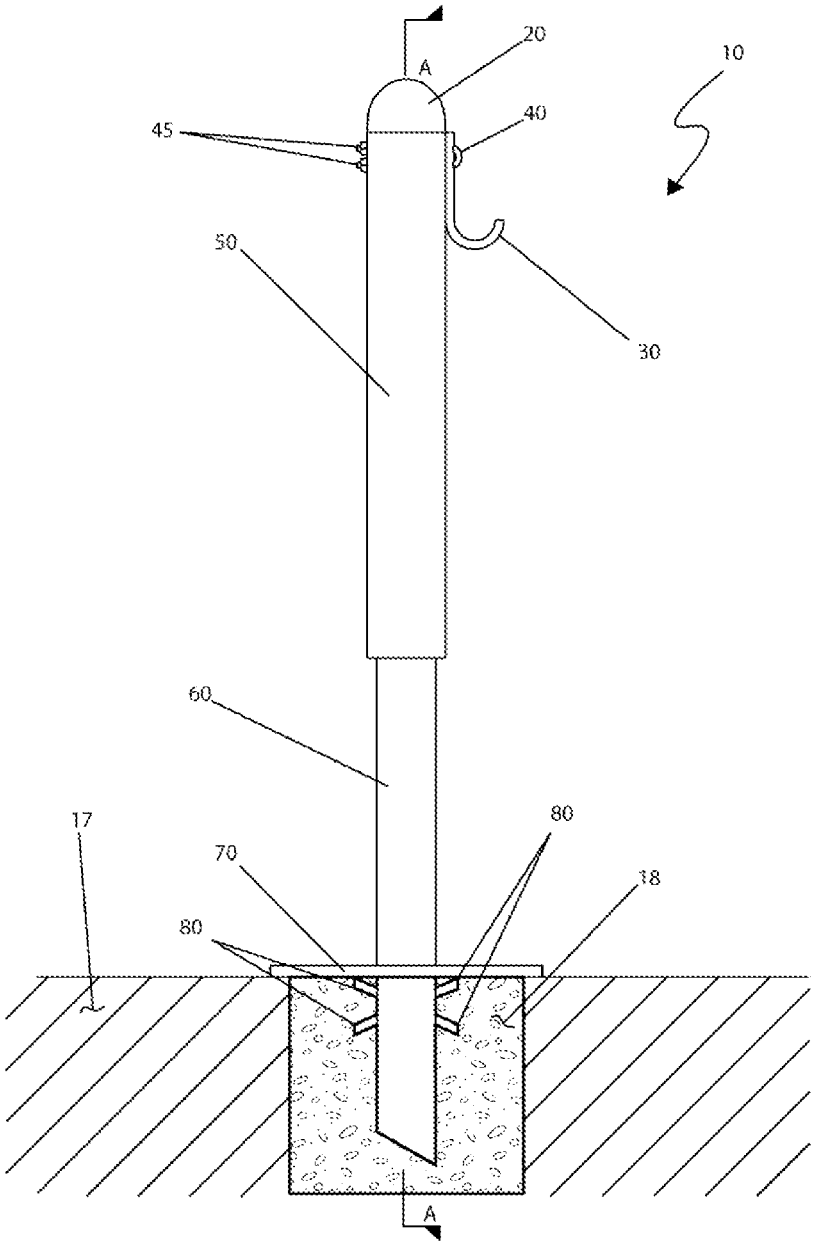
FIG. 1 is a side view of a ground anchor for trash cans 10, according to a preferred embodiment of the present invention.
Figure 2:
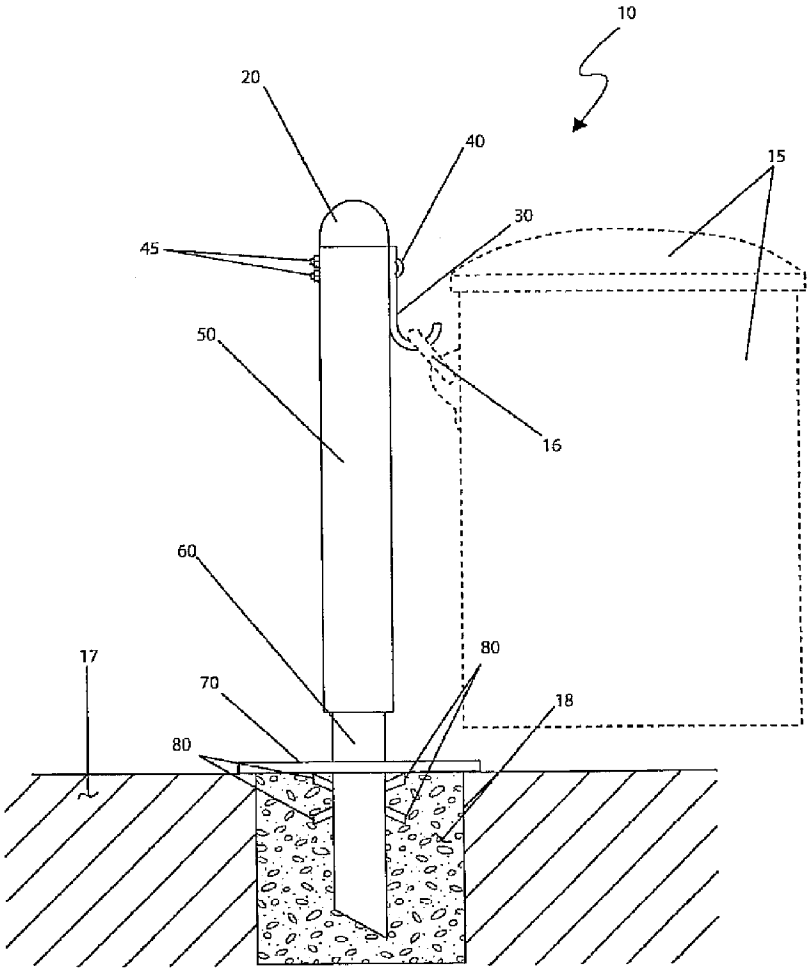
FIG. 2 is another side view of the ground anchor for trash cans 10 depicting an in-use state, according to a preferred embodiment of the present invention; and, FIG. 3 is a section view of the ground anchor for trash cans 10 taken along line A-A in FIG. 1, according to a preferred embodiment of the present invention.
Figure 3:
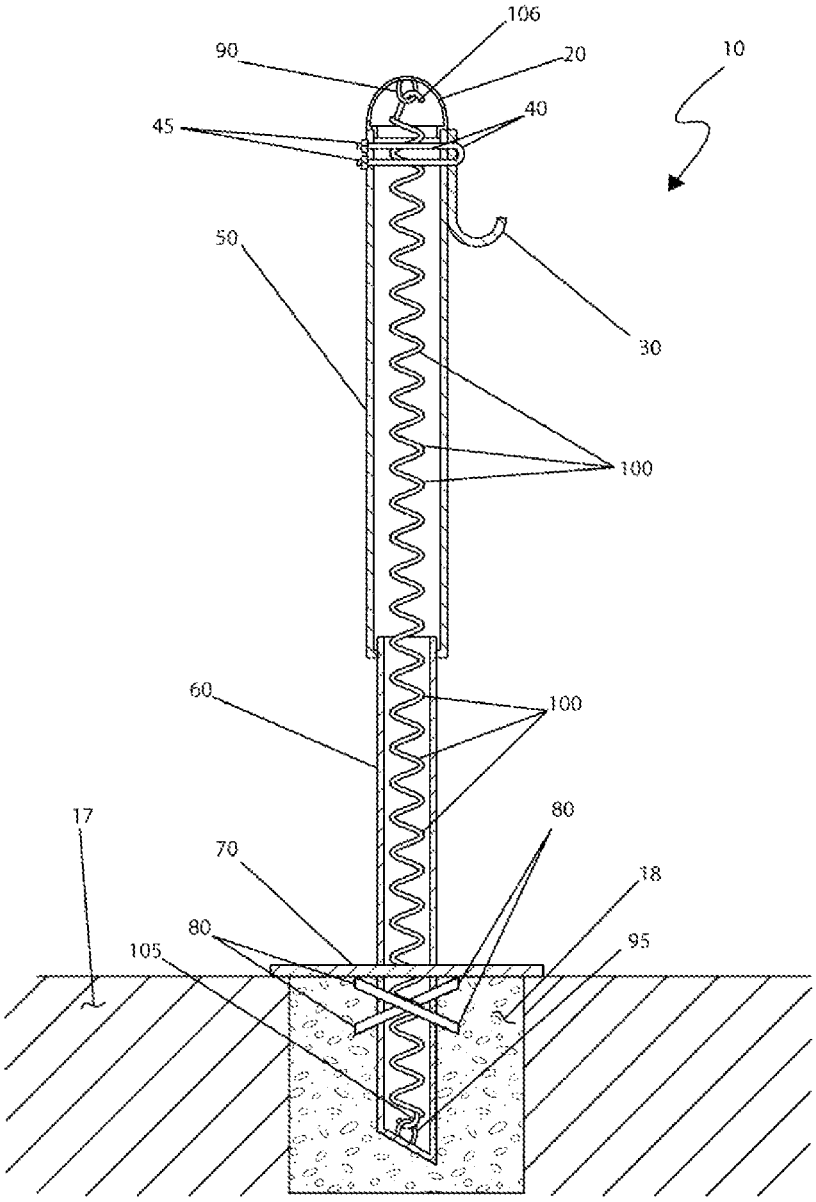

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a ground anchor for trash cans (herein described as the "apparatus") 10, which provides a means for retaining a trash can 15 in a secure position, thereby preventing the trash can 15 from blowing away, scavenging animals, or from becoming lost. The apparatus 10 comprises a cap 20, a hook 30, a sliding member 50, a fixed member 60, and a spring 100. The apparatus 10 is approximately four (4) feet in length and may be fabricated in a variety of colors, patterns, or logos that which complement a structure's exterior. The apparatus 10 is utilized in conjunction with an existing trash can 15. Various trash can 15 styles which comprise a handle 16 may be utilized with the apparatus 10.

Referring now to FIG. 1, a side view of the apparatus 10, according to the preferred embodiment of the present invention, is disclosed. The apparatus 10 comprises a cylindrical form fabricated from materials such as, but not limited to: steel, polyvinyl chloride (PVC), or the like and may also be coated with a plastic or a rubberized coating, thereby protecting the apparatus 10 from the weather, automobiles, or the like. An upper portion of the apparatus 10 comprises a sliding member 50, thereby providing a retaining means to a trashcan 15 and a protecting means to internal components. The sliding member 50 is approximately two (2) inches in diameter and thirty (30) inches in length with an approximate stroke length of ten (10) inches to allow for various lengths of conventional trash cans 15. The upper distal portion of the sliding member 50 comprises a conventional circular fencing cap 20, thereby providing an aesthetically pleasing decorative cover to the upper distal portion. The cap 20 is an appropriate diameter to engage the upper portion of the sliding member 50 and secure thereto via an interference fitting means.

An upper side portion of the sliding member 50 comprises at least one hook 30 providing a means to secure and suspend the trash can 15. In a preferred embodiment, a single hook 30 is attached to the sliding member 50 via a common "U"-bolt 40 and a pair of fasteners 45. The "U"-bolt 40 is inserted through the hook 30 and sliding member 50 and secured at an opposite side with fasteners 45 such as, but not limited to: nuts, rivets, or the like. The hook 30 is approximately twenty-seven (27) inches from a ground surface 17, thereby allowing various sized trash cans 15 to be utilized, and fabricated from durable materials such as, but not limited to: plastic, metal, or the like. In other embodiments, the sliding member 50 comprises a plurality of hooks 30 affixed thereto. The hooks 30 are preferably disposed at, at least ninety degree (90°) increments around the circumference of the sliding member 50. Each hook 30 is attached to the sliding member 50 by at least one mechanical fastener, including but not limited to, screws, bolts, nuts, or the like. In a two (2) hook embodiment, the hooks 30 are preferably positioned at one hundred eighty degree) (180° increments and in a three (3) hook embodiment, the hooks 30 are preferably positioned at one hundred twenty degree (120°) increments. Although other quantities and relative positions of hooks 30 can be utilized without altering the scope of the apparatus.

A bottom portion of the apparatus 10 comprises a fixed member 60, thereby providing a means for the apparatus 10 to be secured into the ground surface 17 and providing a means for the sliding member 50 to travel thereupon. In use, approximately fourteen (14) inches of a bottom portion of the fixed member 60 is inserted into the ground surface 17 and a bonding material 18 such as, but not limited to: cement, concrete, or the like fills around the fixed member 60, thereby securing the apparatus 10 into the ground portion 17. The bottom portion of the fixed member 60 which is inserted into the bonding material 18 comprises a support means 80 which is preferably rebar, yet other devices which reinforce a structure may also be utilized without limiting the functions of the device. The fixed member 60 also comprises a ground plate 70, thereby providing a stabilization means to the upper portions of the apparatus 10. The ground plate 70 is preferably a disc-shaped device fabricated from a durable material which engages the top portion of the ground surface 17 once the apparatus 10 is inserted thereinto.

Referring now to FIG. 2, another side view of the apparatus 10, according to the preferred embodiment of the present invention, is disclosed. In use, the apparatus 10 is compressed, thereby enabling the sliding member 50 to travel downwardly on the fixed member 60 via a spring 100 (see FIG. 3). A handle 16 on the trash can 15 is then positioned onto the hook 30, thereby allowing the trash can 15 to be securely suspended thereon. The weight of the trash can 15 enables the apparatus 10 to remain in a compressed state until removal of the trash can 15.

Referring now to FIG. 3, a section view of the apparatus 10 taken along line A-A in FIG. 1, according to the preferred embodiment of the present invention, is disclosed. Internally, the apparatus 10 comprises a first catch 90, a second catch 95, a spring 100, a lower spring hook 105, and an upper spring hook 106, thereby enabling the apparatus 10 to compress and retract. The first catch 90 is attached to an intermediate inner portion of the cap 20, thereby enabling the upper spring hook 106 to be attached thereto. The second catch 95 is attached to an intermediate inner bottom portion of the fixed member 60, thereby enabling a lower spring hook 105 to be attached thereto. The first catch 90 and second catch 95 are comprised of circular eyelet devices which allow the spring hooks 105, 106 to fastener onto, respectively. Each catch 90, 95 is attached to their respective locations via fastening means such as, but not limited to: adhesive, integral molding, threadably engaging, or the like. Each hook 105, 106 is integral parts of a conventional spring 100. The conventional spring 100 is preferably a hardened steel tension spring, yet other elastic device or springs may be utilized without limiting the features of the apparatus 10. The spring 100 is located at an intermediate position within the sliding member 50 and fixed member 60.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: acquiring the apparatus 10; digging a level hole approximately two (2) foot by six (6) foot at a desired trash pick-up location; inserting the fixed portion 60 of the apparatus 10 into the hole with the ground plate 70 engaging a top portion of the ground surface 17; pouring a conventional bonding material 18 around the bottom portion of the fixed portion 60 and covering the support means 80; allowing the bonding material 18 to cure; positioning a trash can 15 upon the hook 30; allowing the sliding member 50 to travel downwardly towards the fixed member 60, thereby enabling the spring 100 to compress; removing the trash can 15 as desired and allowing the spring 100 to retract; utilizing the apparatus 10 as necessary; and, retaining trash cans 15 in an effective manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An anchor for at least one trash can comprising:

a fixed member comprising a lower portion rigidly mounted to a ground surface having a closed bottom end and an upper portion, further comprising a tubular member having an open top end;

a sliding member telescopingly mounted to said fixed member comprising a tubular member having a closed top end and an open bottom end to receive said upper portion of said fixed member;

wherein said sliding member and said fixed member are cooperatively mounted such that said sliding member moves with respect to said fixed member in a vertical direction; and, a planar ground plate affixed above said fixed member lower portion to engage said ground surface and stabilize said fixed member;

at least one hook affixed to said sliding member to releasably secure at least one trash can; and, a helical compression spring further comprising an upper spring hook to attach to said sliding member and a lower spring hook to attach to said fixed member spring;

wherein said fixed member closed bottom end further comprises an upwardly protruding catch disposed on an inner central location to receive said lower spring hook and said sliding member closed top end further comprises a downwardly protruding catch disposed on an inner central location to receive an upper spring hook;

wherein said spring resists an applied compression force applied by said sliding member when said at least one trash can is secured to said at least one hook;

wherein said fixed member closed bottom end further comprises an angled planar surface for insertion into said ground surface;

wherein said sliding member closed top end further comprises an attachable circular cap; and, wherein said hook is affixed to said sliding member using a U-bolt inserted through a pair of fastening apertures in said hook and two pair of opposing fastening apertures in said sliding member and a pair of nut fasteners attached thereto.

2. The anchor of claim 1, wherein said fixed member lower portion is secured within a concrete bonding material;

wherein said bonding material is applied to a recess in said ground surface; and, wherein said fixed member lower portion further comprises at least one length of rigidly affixed rebar providing a means of supporting said fixed member within said bonding material.

3. The anchor of claim 2, wherein said cooperatively mounted sliding member and fixed member further comprise a combined length of approximately forty-eight inches;

wherein said sliding member further comprises a length of approximately thirty inches;

wherein said fixed member lower portion further comprises a length of approximately fourteen inches;

wherein said hook is affixed to said sliding member at approximately twenty-seven inches above said ground surface; and, wherein a deflection distance of said spring compression force comprises approximately ten inches.

4. The anchor of claim 3, wherein said sliding member, said fixed member, and said at least one hook further comprise a rubberized exterior coating.

5. The anchor of claim 4, wherein said at least one hook is adapted for attachment to a perimeter lip of said at least one trash can.

6. The anchor of claim 4, wherein said at least one hook is adapted for attachment to a handle of said at least one trash can.

* * * * *